US006280355B1

(12) United States Patent
Hauptman et al.

(10) Patent No.: US 6,280,355 B1
(45) Date of Patent: Aug. 28, 2001

(54) RACKET STRINGING CLAMP

(76) Inventors: Madeline Mishel Hauptman, P.O. Box 301-H, Scarsdale, NY (US) 10583; David S. Luskin, 483 Opihikao Pl., Honolulu, HI (US) 96825

( * ) Notice: Subject to any disclaimer, the term of this patent is extended or adjusted under 35 U.S.C. 154(b) by 0 days.

(21) Appl. No.: 09/338,944

(22) Filed: Jun. 25, 1999

Related U.S. Application Data

(63) Continuation-in-part of application No. 09/118,456, filed on Jul. 17, 1998.

(60) Provisional application No. 60/078,981, filed on Mar. 19, 1998, provisional application No. 60/073,891, filed on Feb. 6, 1998, and provisional application No. 60/070,431, filed on Jan. 5, 1998.

(51) Int. Cl.[7] ..... A63B 51/14

(52) U.S. Cl. ..... 473/557

(58) Field of Search ..... 473/556, 557; 269/166, 169

(56) References Cited

U.S. PATENT DOCUMENTS

| | | | | |
|---|---|---|---|---|
| 3,999,756 | | 12/1976 | Head . | |
| 4,049,268 | * | 9/1977 | Ray | 473/557 |
| 4,184,679 | | 1/1980 | Mishel . | |
| 4,359,213 | * | 11/1982 | Bachman et al. | 473/556 X |
| 4,874,170 | * | 10/1989 | Zech | 473/557 |

FOREIGN PATENT DOCUMENTS

3149810 * 6/1983 (DE) .

* cited by examiner

*Primary Examiner*—Raleigh W. Chiu

(57) ABSTRACT

A racket stringing clamp for clamping diagonal racket strings which clamp has generally configured teeth projecting into spaces which are to be bordered by string segments. The clamp includes jaws for gripping two substantially parallel string segments. A handle including a cam serves to move the jaw.

2 Claims, 9 Drawing Sheets

FIG. 8
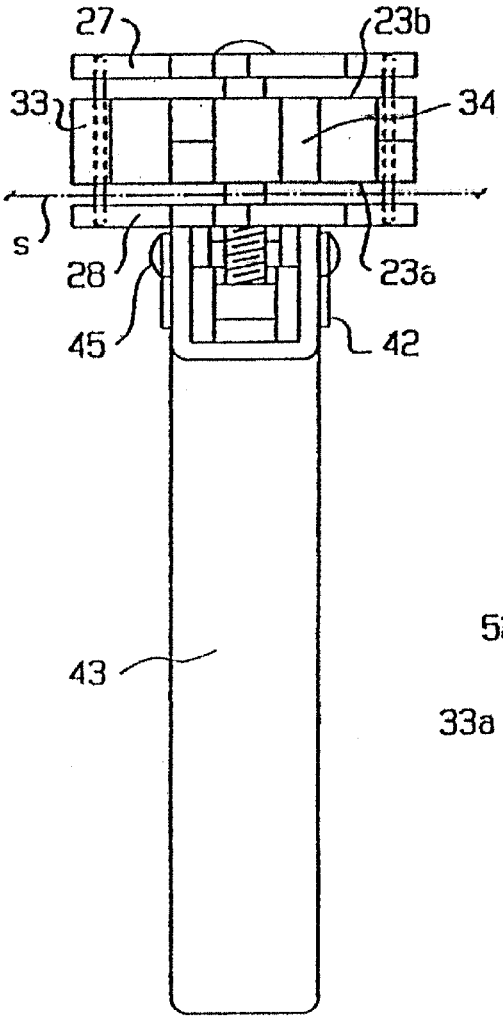
FIG. 9
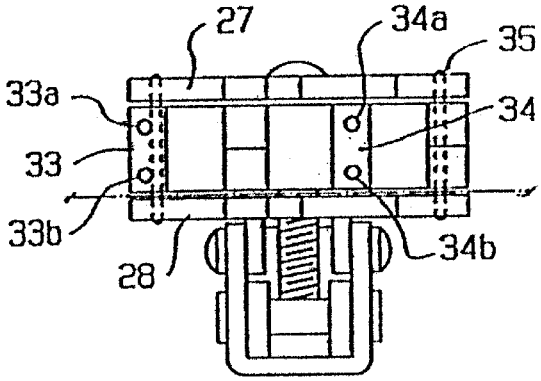
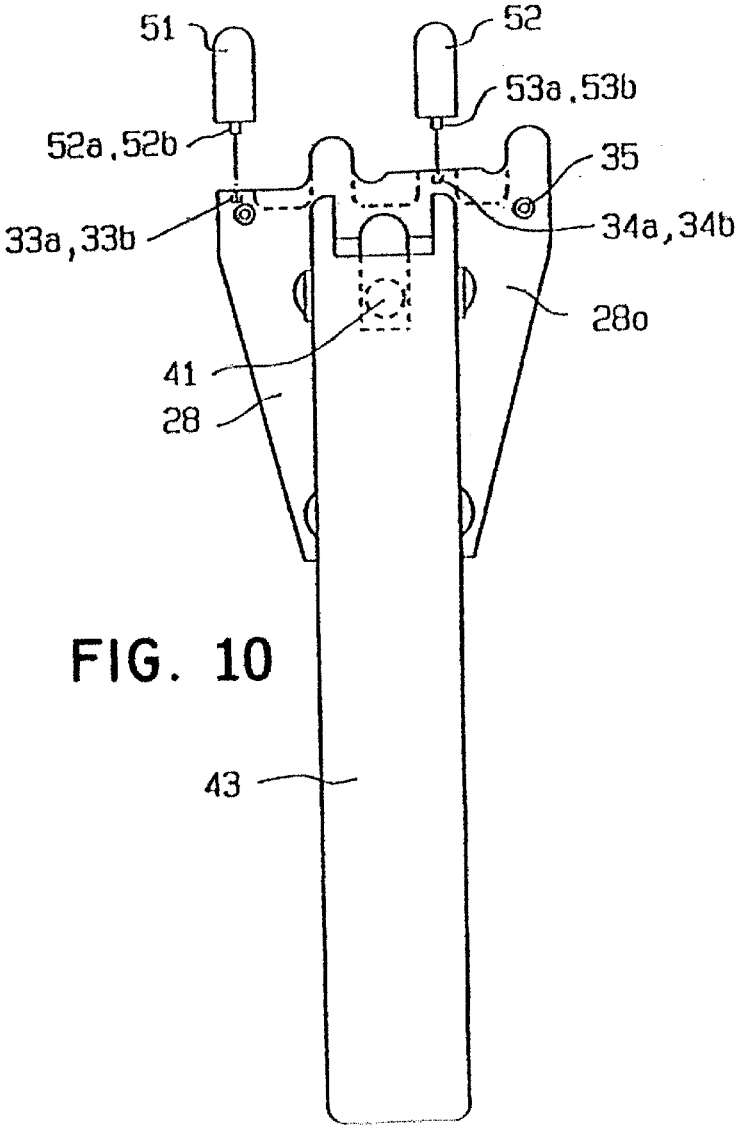
FIG. 10

RACKET STRINGING CLAMP

RELATED APPLICATIONS

This application is a continuation-in-part of pending U.S. patent application Ser. No. 09/118,456 filed Jul. 17, 1998 which is related to U.S. Provisional Application Ser. No. 60/070,431 filed Jan. 5, 1998 entitled "Improved Method And Product For Stringing Game Racket"; U.S. Provisional Application Ser. No. 60/073,891 filed Feb. 6, 1998 entitled "Racket Frame With Improved String Support Means For Stringing Game Racket"; and U.S. Provisional Application Ser. No. 60/078,981 filed Mar. 19, 1998 entitled "Markings For String, Frame And Grommets Of Game Rackets".

BACKGROUND OF THE INVENTION

The present invention is an improvement in game rackets and their stringing and, in particular an improvement directed to the teachings of U.S. Pat. No. 4,184,679 including overcoming certain difficulties stringers found in stringing such rackets. There was resistance on the part of the stringers to learn the pattern disclosed in the '679 patent as it was found by many to be complicated to learn and too time consuming in practice. Certain tennis playing consumers, for example, did not want to buy the product disclosed in the '679 patent because it was difficult to get it restrung. Further the prior art rackets which included diagonal and horizontal string segments had the drawback that during the stringing process, when any reasonable tension was applied to the strings, distortion of the frame would occur.

Prior art three string rackets had the further complication that restringing could not in many instances be done on conventional stringing machines. Special clamps were needed to string the diagonal strings which clamps were not compatible with many stringing machines and the process of inserting verticals first took much more time than conventional stringing.

SUMMARY OF THE PRESENT INVENTION

The present inventive racket, method of stringing and stringing apparatus provide a simpler and improved system permitting racket stringing and restringing be accomplished on all stringing machines using conventional clamps or the improved clamp of the present invention. The first step in the present invention stringing method is to determine the stringing pattern having diagonal string segments and vertical or horizontal string segments. The number of string segments and the size of angles of intersection or crossovers are selected depending on the shape and size of the racket to be strung. Formulas assist in pattern formation. Once the pattern is determined holes or other siring supports are located on the racket head and the racket is ready for stringing.

Stringing starts with the placing of first and second sets of opposing diagonals on or in the string supports such that the second set overlies the first diagonal set or vice versa. The stringing of the first and second diagonal sets are accomplished by alternately inserting and subsequently tensioning string segments in each direction, generally starting at the top, mid-region or bottom of the frame. When all or substantially all of the diagonal string segments have been inserted, a set of verticals (or horizontals) are then strung by weaving them over the upper diagonals and under the lower diagonals.

The angle of the diagonal string segments are selected to avoid any shortening, widening, narrowing or other distortion of the frame. The angle of the diagonals to the racket horizontal centerline and the angle of intersection of each of the diagonals is determined based on a number of factors discussed below. Preferably, diagonal segments at approximately 45° to the horizontal centerline are used; however, diagonals more or less vertical in orientation may be used provided the diagonals have the ability to counteract the horizontal forces that would otherwise warp the racket when stringing rackets in this diagonals-first method. Preferably diagonals are in the ranges of 35°–55° or 40°–50° or 43° to 47°. Algebraic formulae serve to calculate the symmetric three-directional vertical-diagonal pattern across the racket face. A method and formula for assuring that an over/under weave is achieved throughout the string pattern is also included in the present invention.

Orthogonal crossing diagonals permit use of conventional swivel or floating clamps. Floating clamps may also be used on machines that do not have swivel clamps but use rail clamps for mains and floating clamps for diagonals.

The present invention also includes a method of stringing using racket and string identifications which are coordinated to assist in stringing.

Finally, the invention includes improved clamps which are helpful in three set stringing on some machines.

BRIEF DESCRIPTION OF THE DRAWINGS

FIG. 8 is a top plan view of the clamp in the open position;

FIG. 9 is a view similar to FIG. 8 of the clamp in the closed position (handle omitted);

FIG. 10 is an alternative embodiment of the clamp with holes to receive removable additional projection teeth;

DESCRIPTION OF THE PREFERRED EMBODIMENT

Figure 1:
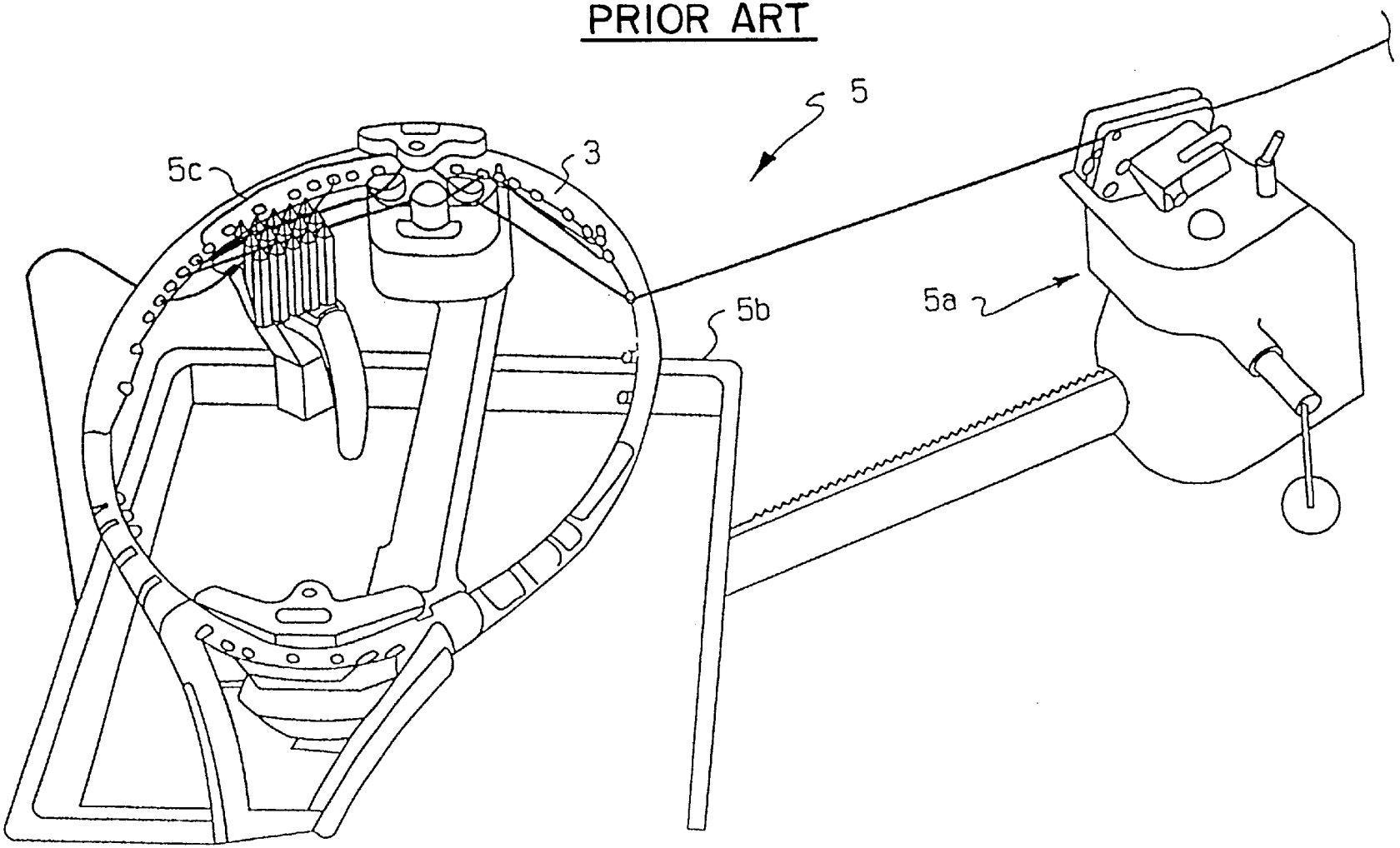
FIG. 1 PRIOR ART
FIG. 1 is a partial perspective View of a stringing machine with a racket frame positioned for stringing.
Figure 2:
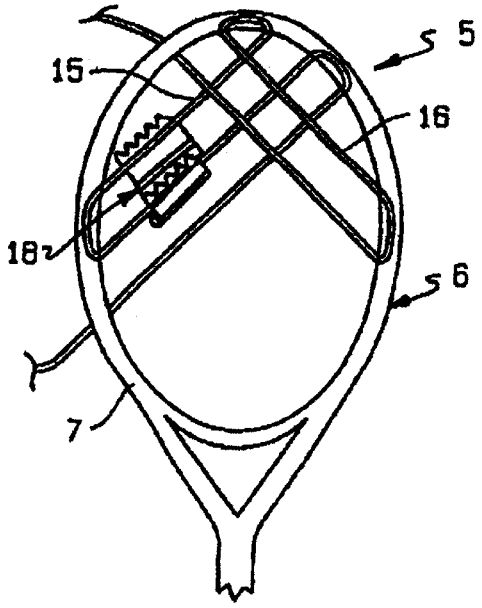
FIG. 2 PRIOR ART
FIG. 2 is a front elevational view of the racket in the process of having its diagonals strung.

In FIG. 1 a conventional stringing machine 5 is shown for stringing a three-string racket 3 of the present invention. Also shown is stringing machine tension arm 5*a*, machine frame 5*b* and clamp 5*c*.

Figure 3:
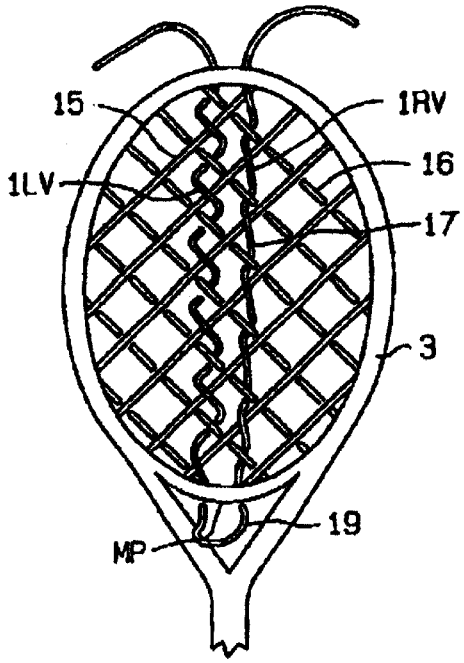
FIG. 3 PRIOR ART
FIG. 3 is a front elevational view of the racket with its diagonals in place and vertical stringing commenced.
Figure 3A:
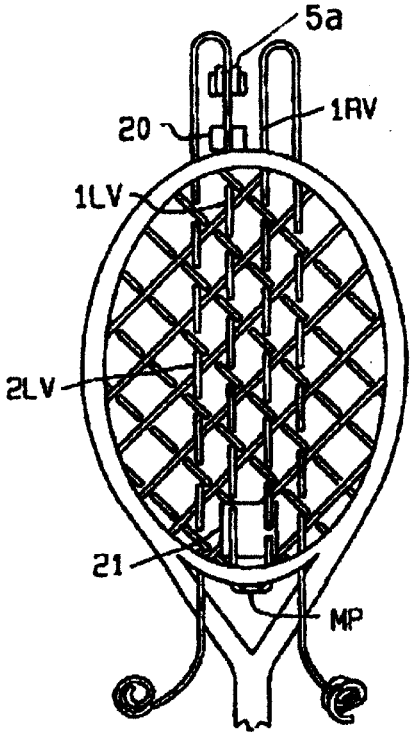
FIG. 3a PRIOR ART
FIG. 3*a* is a view similar to FIG. 3 with vertical stringing continuing.
Figure 3B:
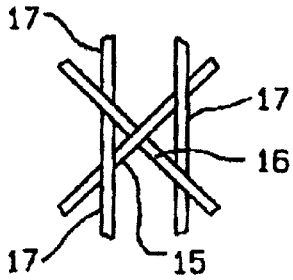
FIG. 3b PRIOR ART
FIG. 3*b* is a partial elevational view showing a string segment weave.

Turning to FIGS. 2, 3, 3*a* and 4, stringing is commenced with left diagonal segments underneath right diagonal segments 16. A string segment is a straight tensioned length of string extending from one inside edge of the frame to another inside frame edge. All left diagonal segments are under all right diagonal segments or vice versa. After stringing the diagonals 15, 16, a group of vertical segments 17 which segments are individually assigned designations 1RV and 1LV (first right and left verticals) on either side of the vertical centerline through head midpoint (MP) are strung using vertical string length 19 (FIG. 3). Verticals may, alternatively, be started at other locations. Further vertical stringing is shown in FIG. 3*a*. Stringing is clamped by starting clamp 20, clamp 21 of the present invention (described in detail below) and machine tensioning arm 5*a*. Vertical segments are woven over the upper diagonals and under the lower diagonals. Turning to FIG. 3*b*, the weave of string segments is seen in which vertical segments 17 are positioned over the upper left diagonal segments 15 and vertical segments 17 are positioned under the lower right diagonal segment 16 and left diagonal segment 15 is over right diagonal segment 16. Stringing is preferably at low to mid tension range.

The method of stringing a racket comprises the steps of alternately stringing and then tensioning substantially both sets of opposing diagonals with conventional or improved tensioning equipment, then interlacing and tensioning the set of vertical strings, using conventional tensioning clamps that accompany stringing machines or clamps of the present invention clamps.

Figure 4:
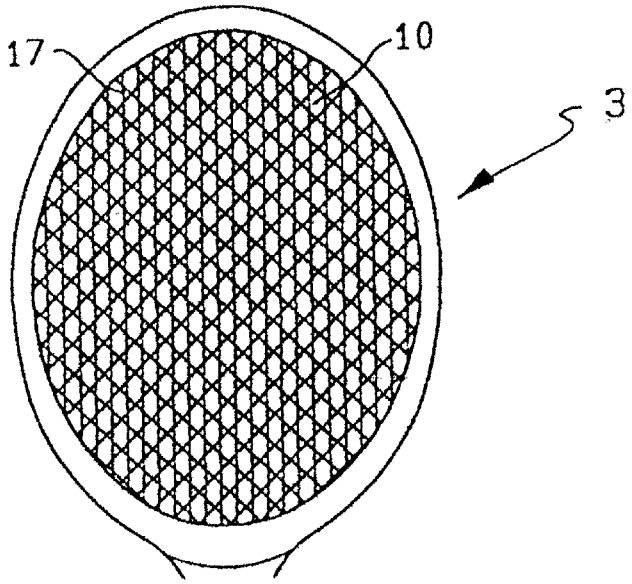
FIG. 4 PRIOR ART
FIG. 4 is a three-string racket strung with diagonals and verticals.
Figure 5:
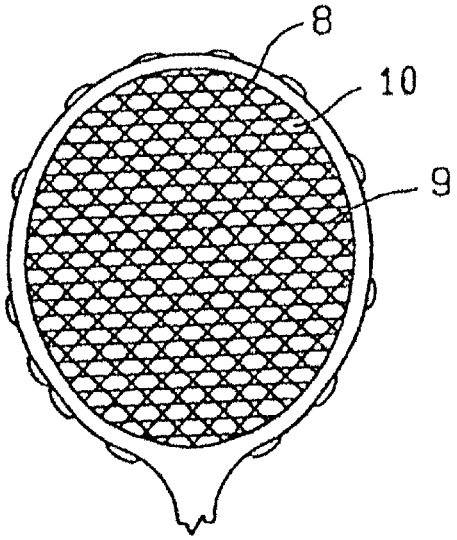
FIG. 5 PRIOR ART
FIG. 5 is a racket strung with diagonals and horizontals.
Figure 6:
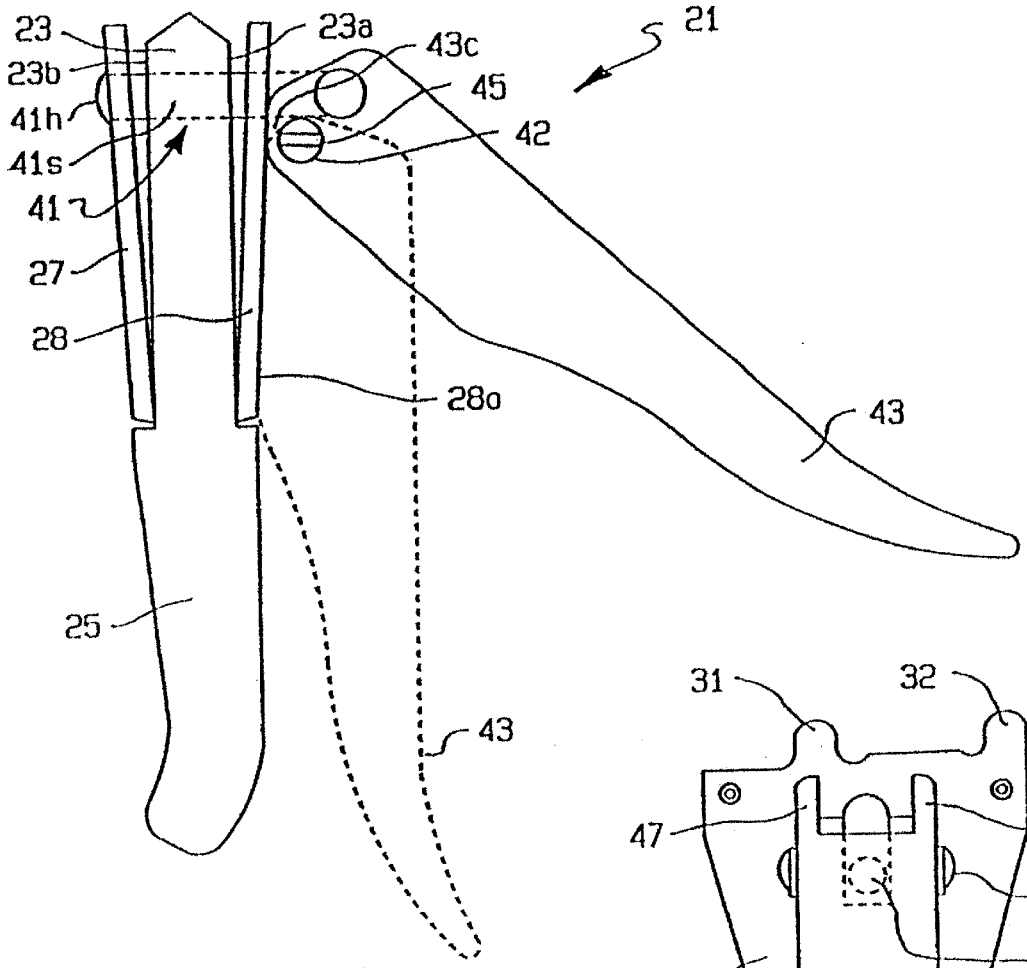
FIG. 6 is an elevational view of the clamp of the present invention showing the side of the clamp handle.

FIG. 4 shows a fully strung racket 3 having vertical segments, and FIG. 5 illustrates a racket head in which horizontal segments are used instead of vertical segments. The stringing patterns of the present invention provide (1) intersection of diagonals at points midway between verticals 17 (i.e. points A and B, FIG. 14), and (2) provide a plurality of hexagonal and triangular openings 8, 9 and 10. Opening 10 is the same size and shape of the area defined by points A, L, T, B, S and M. Openings 8, 9 and 10 vary in size and shape depending on spacing of the string segments and the angles of crossing of the string segments.

Turning to FIGS. 6–10, portable string clamp unit 21 includes body 23 with two side walls 23*a*, 23*b*, lower handle 25 and clamp plates 27, 28. Unit body 23 has two (2) upwardly extending projections or teeth 31, 32 and two projection bases 33, 34 each having holes 33*a,b* and 34*a,b*. Clamp unit 21 includes clamping arrangement 40 including bolt 41 with head 41*h* and stem 41*s*. Stem 41*s* is connected to cross pin 42 in clamp lever 43, which pivots on axle 45 mounted on clamp body extensions 47, 48. Clamp lever 43 has cam section 43*c* which rides on the outside surface 28*o* of plate 28. Also shown are alignment pins 35 and plate extensions 36 and 37.

In operation, clamp unit 21 is positioned with teeth 31 and 32 engaging racket segment strings. With reference to FIG. 10, a string (S) is positioned between head surface 23*a* and plate 28. When lever 43 is moved downward cam 43*c* engages plate surface 28*o* pulling bolt 41 to move surface 23*a* and plate 28 toward one another to grip string (S). As cam 43*c* rotates further clockwise (FIG. 6) it snaps into a lock position (shown in dashed lines FIG. 6) holding string (S) without the operator gripping the clamp unit 21.

Turning to FIG. 10, additional projections 51, 52 having pegs 52*a,b* and 53*a,b* are fitted into spaced apart holes 33*a,b* and 34*a,b* of bases 33, 34 to provide additional projections for string engagement when needed for racket stringing. Portable string clamp unit 21 has the versatility of being operated with two, three, four, five or more teeth or projections.

Figure 11:
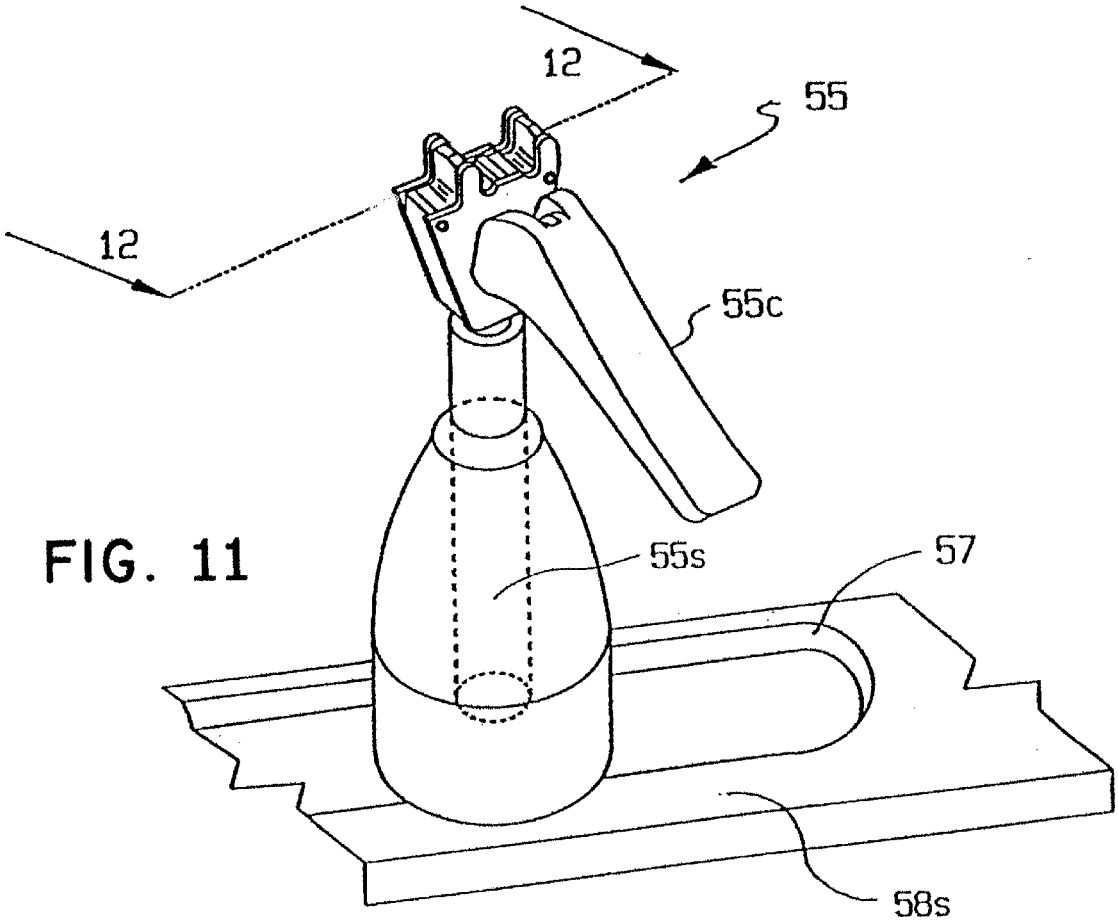
FIG. 11 is a perspective view of an alternative clamp adapted to be used in a clamp holder associated with a stringing machine.
Figure 12:
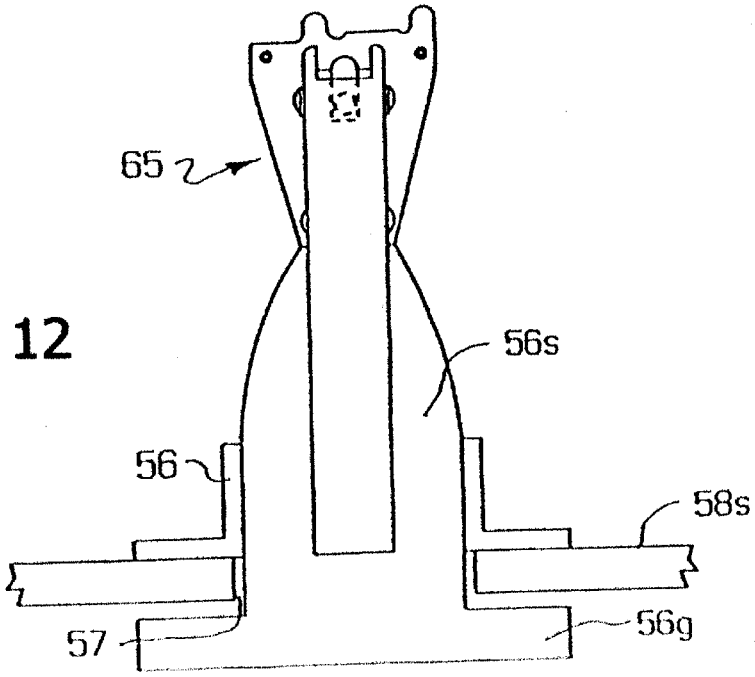
FIG. 12 is a side sectional view of the alternative clamp and its holder mounted on the stringing machine.
Figure 13:
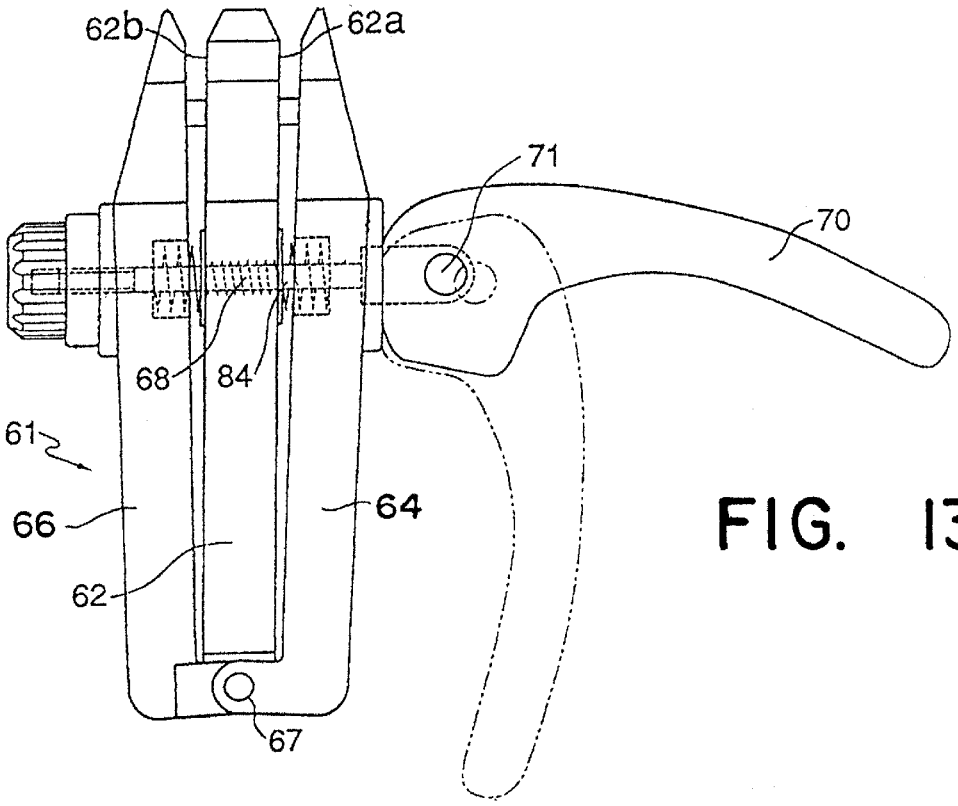
FIG. 13 is a side elevational view of an alternative string clamp.

In FIGS. 11 and 12, a string clamp unit 55, similar in construction to unit 21 is mounted in a holder 56 which holder 56 in turn is mounted in track 57 of stringing machine 58 for reciprocation therein. Clamp unit 55 has a lower cylindrically shaped stem 55*s*. Holder 56 includes skirt 56*s* which rides on horizontal machine surface 58*s* while holder guide 56*g* assists in stabilizing holder 56 as it is manipulated. Also shown is clamp handle 55*c*.

Figure 14:
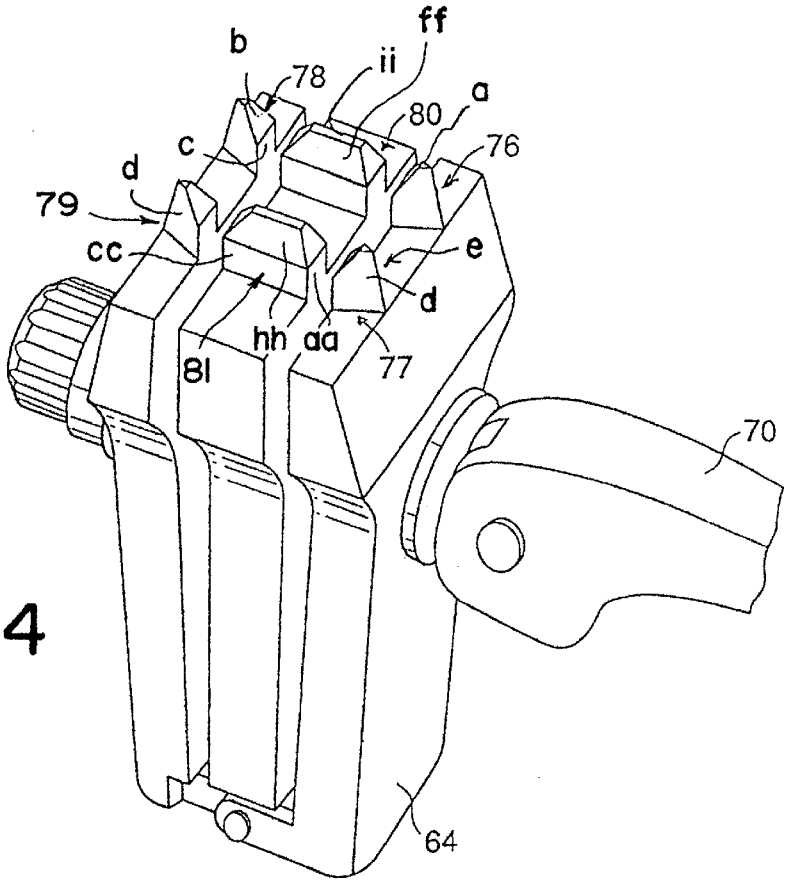
FIG. 14 is a perspective view of the clamp of FIG. 13 showing shaped teeth.
Figure 15:
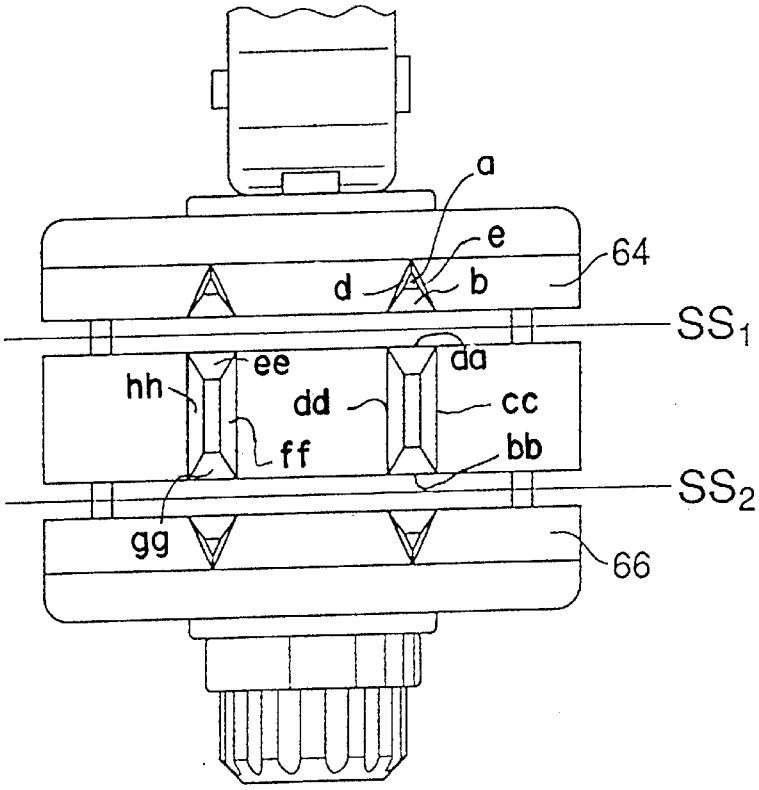
FIG. 15 is a plan view of the clamp with the jaws open.
Figure 16:
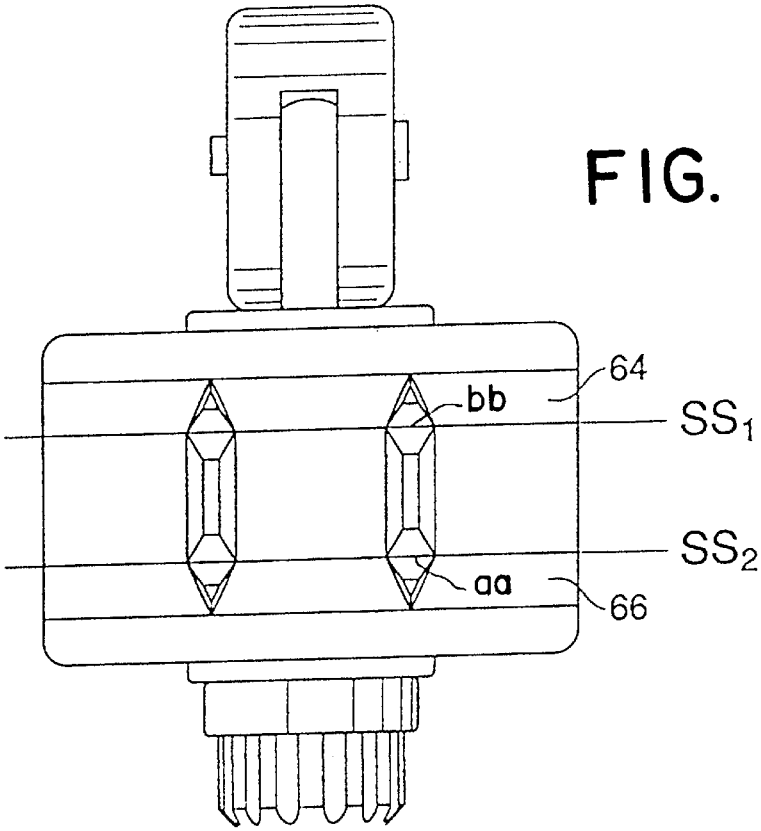
FIG. 16 is a plan view of the clamp with the jaws closed.

A feature of the present invention is to provide a sequence of stringing which is easy to string on conventional stringing equipment with or without use of the above-described clamps depending on the equipment. Where the angles and spacing of the strings are such that conventional clamps do not fit between or among the string segments, the clamps 21, 55 of the present invention may be used. Clamp 21, 55 are sized and shaped at their upper clamping end to permit positioning the clamp in string openings 8, 9 and 10 (FIG. 14).

The present invention is useful for all types of rackets used in the sports of tennis, racquetball squash and badminton.

Turning to FIGS. 13–16, there is shown an alternative string-gripping clamp 61 which includes central body 62, right jaw 64, left jaw 66 pivoted about pivot pin 67. Jaws 64, 66 are clamped against body surfaces 62*a, b* by central bar with cap unit 68 pulled by operation of handle 70 pivoted about pin 71. Bar with cap unit 68 when articulated by handle 70 causes jaws 64, 66 to move toward body surfaces 62*a, b* to grip and hold string segments $SS_1$ and $SS_2$ (see FIGS. 20 and 21).

Figure 17:
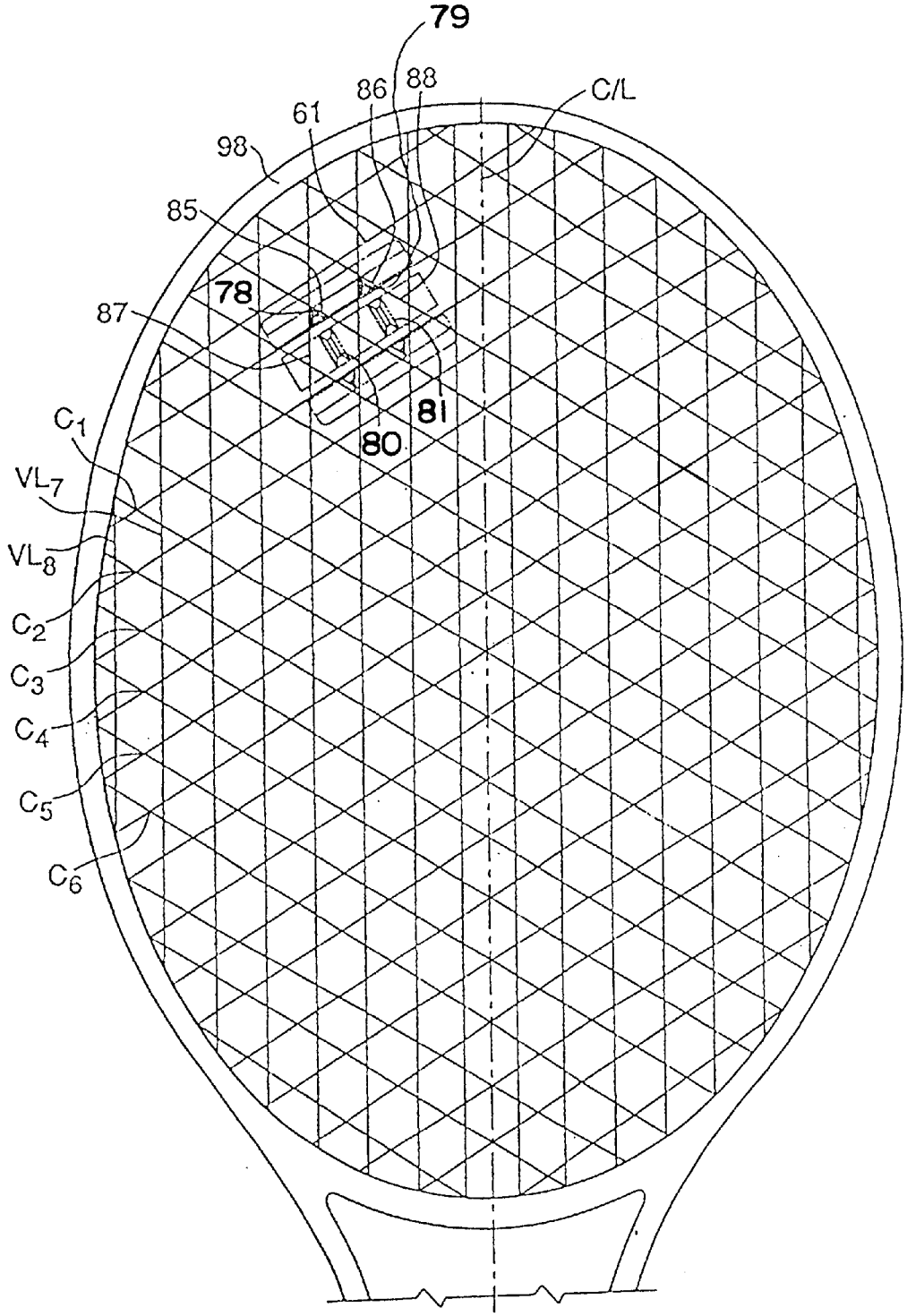
FIG. 17 is a tennis racket frame strung in three directions including vertical and diagonal string segments and showing the clamp of FIG. 13 positioned with its teeth in openings between string segments.

Teeth projection pairs 76, 77 on the top of right jaw 64 and teeth projection pairs 78, 79 on left jaw 66 are generally triangular in cross section with each projection tooth having surfaces a, b, c, d and e. Surface a is the small top surface. Surfaces d and e intersect along lines and those surfaces d and e together with surface b create a tooth which gets generally smaller from its larger bottom adjacent jaws 64, 66 to its top at surface a. The shape of the projections 76–79 facilitates inserting such projections in between string segments (FIG. 17). Projections 76–79 will be positioned in open places between string segments where needed as the weave is being developed. The body portion of clamp 61 also carries a pair of larger teeth projections 80, 81 each having nine (9) surfaces aa–ii. Each projection 80, 81 has two small vertical surfaces aa, bb and two large vertical surfaces cc, dd. Each projection 80, 81 in addition has four tapering surfaces ee, ff, gg and hh. Finally, each projection 80, 81 has a flat surface ii. The tapering surfaces facilitate positioning the projections between and among string segments.

Figure 7:
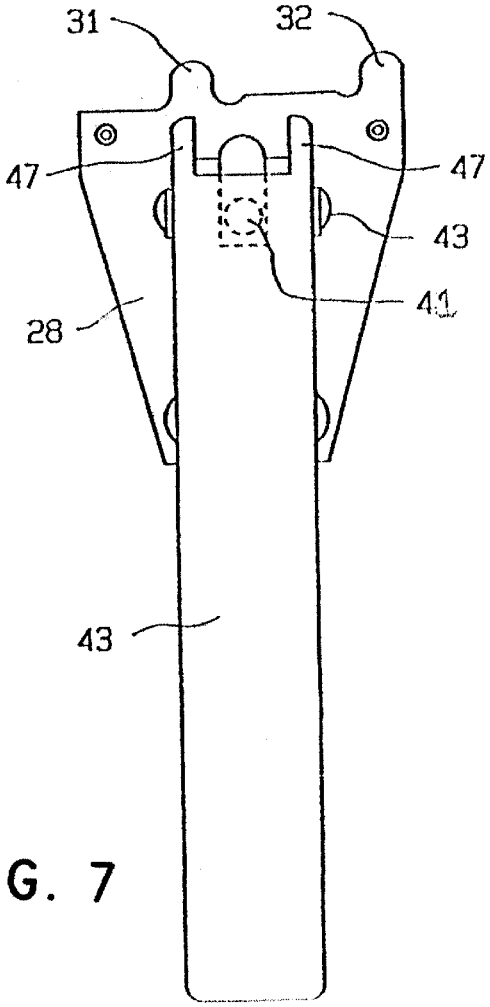
FIG. 7 is an elevational view of the clamp showing the front surface of the handle.

Further with respect to clamp 61 and strung racket of FIG. 7, it is seen how teeth projections 76–81 fit into string openings 85, 86, 87 and 88. String openings 85, 86 are triangular and string openings 87, 88 are polygonal. Finally, while the pattern shown in FIG. 17 includes verticals and diagonals; alternatively, horizontals and diagonals may be used.

What is claimed is:

1. A clamp for clamping strings during the stringing of a racket comprising (a) body portion having one or more generally configured teeth projecting upwardly into spaces which are to be bordered by string segments;

(b) each tooth having a base area adjacent the top surface of the body and a top area which is substantially smaller in area than the base area;

(c) a jaw portion positioned adjacent the body portion; and (d) pulling and clamping means for pulling the body portion toward the jaw portion which means includes a rotatable lever means movable to a lock portion and a horizontal element attached to the lever means and the jaw portion which causes the jaw portion to move as the lever means rotates.

2. A clamp for clamping strings during the stringing of a racket having diagonal string segments in the string pattern comprising (a) a body portion;

(b) two jaw portions movable toward and away from the body portion, each jaw portion having an upper surface; and (c) configured teeth on a jaw portion extending upwardly from the upper surface of the jaw portion, each tooth having a base area and a top area which top area is smaller than the base area and adapted to fit within an opening adjacent diagonal string segments in the string pattern; and (d) pulling and clamping means for pulling the body portion toward the jaw portion which means includes a rotatable lever means movable to a lock portion and a horizontal element attached to the lever means and the jaw portion which causes the jaw portion to move as the lever means rotates.

* * * * *